United States Patent [19]

Ottolini

[11] 4,395,937

[45] Aug. 2, 1983

[54] SHOT GUN WITH GAS TAKE-OFF

[75] Inventor: Leonardo Ottolini, Brescia, Italy

[73] Assignee: Luigi Franchi S.p.A., Fornaci, Italy

[21] Appl. No.: 259,275

[22] Filed: Apr. 30, 1981

[30] Foreign Application Priority Data

Sep. 11, 1980 [IT] Italy ..... 24595 A/80

[51] Int. Cl.[3] ..... F41D 5/04

[52] U.S. Cl. ..... 89/128; 89/191 A; 89/193; 89/1 K

[58] Field of Search ..... 89/128, 191 A, 193

[56] References Cited

U.S. PATENT DOCUMENTS 3,443,477 5/1969 Kaempf ..... 89/128

3,736,839 6/1973 Childers ..... 89/128

*Primary Examiner*—Stephen C. Bentley

*Attorney, Agent, or Firm*—Sughrue, Mion, Zinn, Macpeak and Seas

[57] ABSTRACT

A shot-gun with gas take-off has a fore end stock which is movable longitudinally of the barrel and lockable selectively in each of two positions: in one position gases from the discharge of a cartridge in the gun bleed from the barrel into the chamber of a piston/cylinder unit to drive the piston to operate an arming rod of the shot gun automatically. In the other position, a valve member prevents the discharge gases from entering the cylinder chamber, these gases being vented to the external environment: the stock is rigidly locked to the piston for manual operation of the arming rod by "pump" action on the stock in the latter position.

5 Claims, 5 Drawing Figures

SHOT GUN WITH GAS TAKE-OFF

BACKGROUND OF THE INVENTION

The present invention relates to a shot gun with gas take-off, including: a barrel; an arming rod; a piston-cylinder unit comprising a cylinder fixed with its axis parallel to the barrel and a piston housed in and slidable longitudinally of the cylinder, the piston being operatively connected to the arming rod and the cylinder defining within it a variable-volume chamber closed by the piston; gas bleed means for putting the interior of the barrel in gas-communication with said chamber; and a fore end stock connected to the barrel.

In use of shot guns of the above specified type, should the weapon become jammed by retention of the cartridge case in the firing chamber, the user must operate the breech-block manipulation pin of the gun forcefully in an attempt to regain the use of the weapon. This operation is generally long and difficult and can result in deformation or even breakage of parts of the gun.

SUMMARY OF THE INVENTION

The present invention seeks to obviate this disadvantage by providing a shot gun with gas take-off, of the type specified above, wherein:

said fore end stock is displaceable longitudinally of said barrel between a first position in which said shotgun is manually re-armable and a second position in which said shot gun is automatically re-armable; and wherein said shot gun further includes:

locking means for locking said fore end stock selectively to said piston in said first position of the stock and to said cylinder in said second position of said stock;

resilient biasing means acting on said locking means to bias the latter to lock the stock in each of said first and second positions;

means for releasing said locking means against the action of the biasing means; and valve means in said gas bleed means operatively connected to said fore end stock to prevent gas bleeding from said barrel into said chamber when the fore end stock is in said first position and to allow said bleeding when the fore end stock is in said second position.

Should the weapon according to the invention become jammed by retention of a cartridge case in the firing chamber, the user can rapidly and easily eject the cartridge case and hence re-arm the gun, by locating the movable fore end stock in its first position in which it is rigidly connected to the piston, the locking means preferably comprising a bolt which engages a seat formed in the piston itself; the user can then act on the said fore end stock with a so-called "pumping" action to actuate the arming rod of the gun manually. Once the gun is in operating condition again, the user can, as he wishes, continue to use it by "pumping" the arming rod, or else he can re-establish automatic re-arming by disengaging the bolt from the seat in the piston and engaging it with a seat formed in the cylinder.

Preferably, in accordance with a further characteristic of this invention, the said valve means comprise a tubular shutter mounted coaxially in the cylinder of the said piston-cylinder unit so as to constitute a wall of the variable-volume chamber, the wall being provided with a through hole, and means for angularly displacing the shutter about its longitudinal axis from a first angular position in which the shutter cuts off communication between a gas bleed passage, extending through the walls of the barrel and the cylinder, and the chamber defined between the cylinder and the piston, and a second angular position in which the through hole of the said shutter is substantially aligned with the gas bleed passage.

BRIEF DESCRIPTION OF THE DRAWINGS

Further characteristics and advantages of the present invention will become apparent from the following description of a preferred embodiment, given by way of non limiting example, with reference to the attached drawings, in which.

Figure 1:
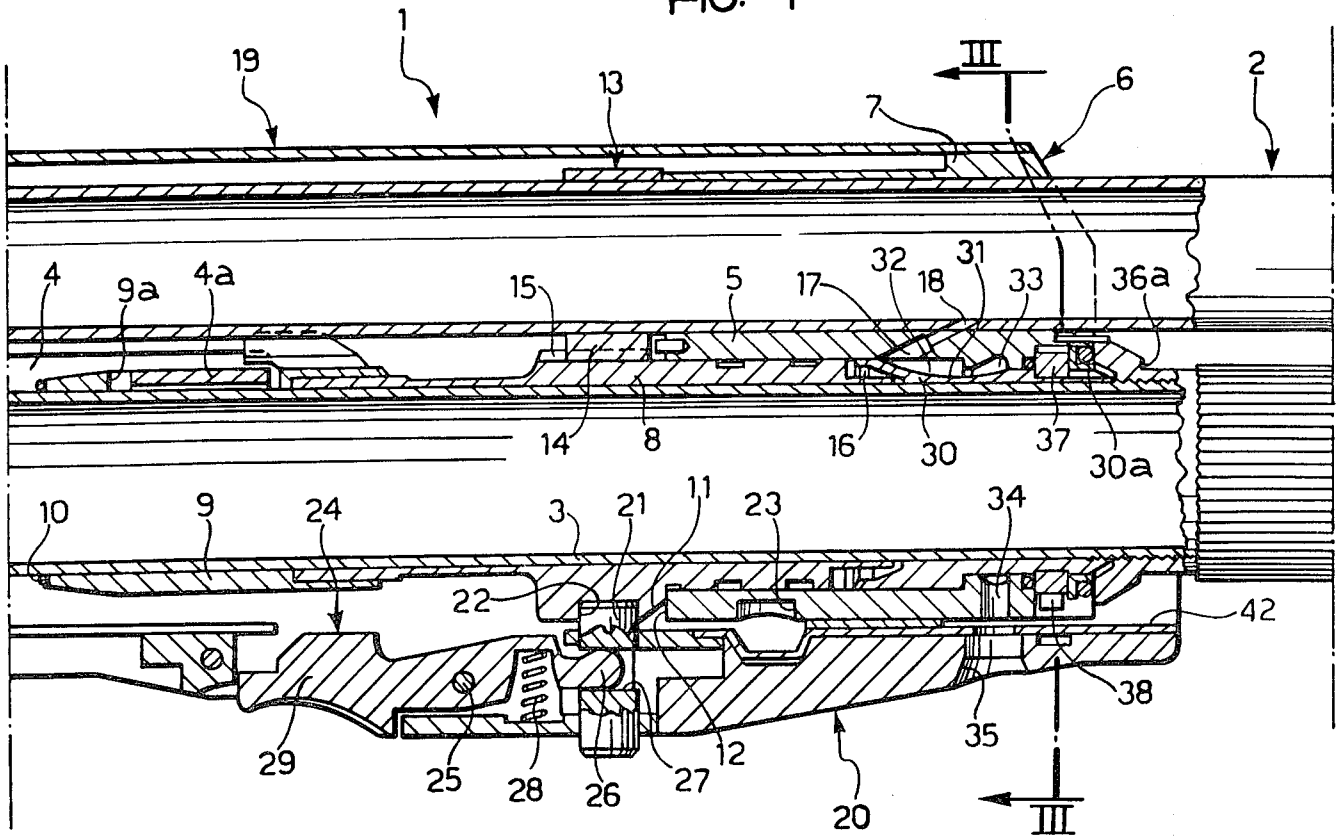
FIG. 1 is a partially-sectioned view of a shot gun according to the present invention in a first operating condition.

The drawings illustrate a front portion of a shot gun 1 including a barrel 2 and a tubular cartridge magazine 3 extending parallel to and beneath the barrel 2 and fixed to the latter by connection means of known type, not shown in the drawings.

The gun is provided with an arming rod 4 disposed parallel to the barrel 2 and having, adjacent its muzzle end, a downwardly-concave, tile-shaped portion 4*a*, guided for sliding movement on the outer wall of the cartridge magazine 3.

The gun is provided with a single-acting piston-cylinder unit operable by discharge gases bled from the barrel, to drive the movement of the arming rod 4.

Figure 3:
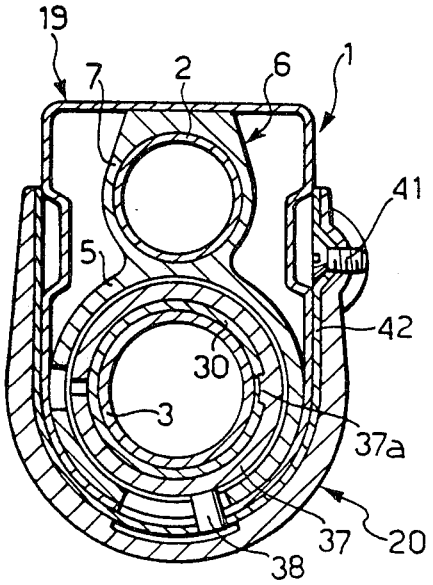
FIGS. 3 and 4 are sections taken on the lines III—III and IV—IV of FIGS. 3 and 4, respectively.
Figure 4:
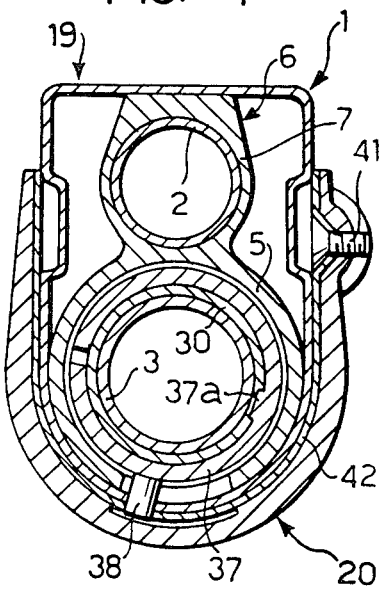

The cylinder of the piston-cylinder unit, which is indicated in the drawings by the reference numeral 5, is tubular and forms part of a unitary support structure 6 having a transverse section in the form of a figure of eight. As illustrated in FIGS. 3 and 4, the lower loop of the support 6 constitutes the said cylinder 5 of the piston-cylinder unit, while the upper loop, indicated by the reference numeral 7, surrounds part of the gun barrel 2 and is rigidly connected thereto.

The piston 8 of the piston-cylinder unit is in the form of a tubular body which is slidably mounted on the magazine 3 within the cylinder 5. A tubular body 9 is fixed coaxially to the rear end of the piston 8 and is also slidable on the cartridge magazine 3; that portion of the body 9 overlying the cartridge magazine 3 is formed with a seat 9*a* in which the front end portion 4*a* of the arming rod 4 is engaged. Thus, the end portion 4*a* of the arming rod 4 of the gun is constrained to follow the axial movements of the piston 8 along the cartridge magazine 3.

A helical spring 10, the front end of which is illustrated in FIG. 1, biases the piston 8, and hence the arming rod 4, towards a forward end-of-stroke position determined by the engagement of an abutment 11, formed on the outer surface of the piston 8, against the rear end surface 12 of the cylinder 5. A ring 13 is also mounted on the gun barrel 2 and is rigidly fixed to the support structure 6. The ring 13 is provided with a radially projecting tooth 14 engaged in a groove 15 formed in the outer surface of the piston 8 so as to prevent rotation of the piston 8 relative to the cartridge magazine 3.

The piston 8 defines, within the cylinder 5, an annular chamber 16 arranged to communicate with the interior of the barrel 2 through a passage 17 formed in the wall of the cylinder 5 and a corresponding passage 18 formed in the barrel 2.

The gun 1 includes a casing 19, surrounding the support structure 6 (see also FIGS. 3, 4) and fixed to the latter.

The lower part of the casing 19 is surrounded by a movable fore end stock 20, preferably made of wood, and of substantially U-shape cross-section. The fore end stock 20 is mounted for sliding movement on the casing 19 parallel to the barrel 2. Conventional stop means (not illustrated) prevent the movable fore end stock 20 from being removed downwardly (see FIGS. 3, 4) from the casing 19.

A metal wall, or lining, 42 is also fixed to the inner surface of the movable fore end stock 20 by means of screws 41 (one of which is illustrated in FIGS. 3 and 4).

The movable fore end stock 20 is provided with a bolt member 21, in the form of a pin, arranged to engage selectively in a seat 22 formed in the outer surface of the piston 8 and in a seat 23 formed in the outer surface of the cylinder 5.

A rocker lever 24 is pivotally mounted on the movable fore end stock 20 about a transverse pin 25 and has an end 26 inserted in a slot 27 formed in the body of the bolt member 21. The end 26 of the rocker lever 24 is thus rigidly connected to the bolt member 21.

A helical spring 28, interposed between the rocker lever 24 and the movable fore end stock 20, biases the rocker lever 24 and the member 21 towards the position in which the member 21 engages in one of the two seats 22, 23. The end of the rocker lever 24 opposite the end 26 is indicated by the reference numberal 29 and is in the form of a control key. The key 29 can be operated so as to rotate the lever 24 in a clockwise sense (with reference to FIGS. 1 and 2) against the action of the helical spring 28, to displace the bolt member 21 out of engagement with either one of the seats 22, 23.

FIG. 1 illustrates the movable fore end stock 20 in a first position axially of the gun in which the gun can be re-armed manually by pump action: in this position the bolt member 21 engages in the seat 22 in the piston 8, so that the movable fore end stock 20 is rigidly connected to the piston.

Figure 2:
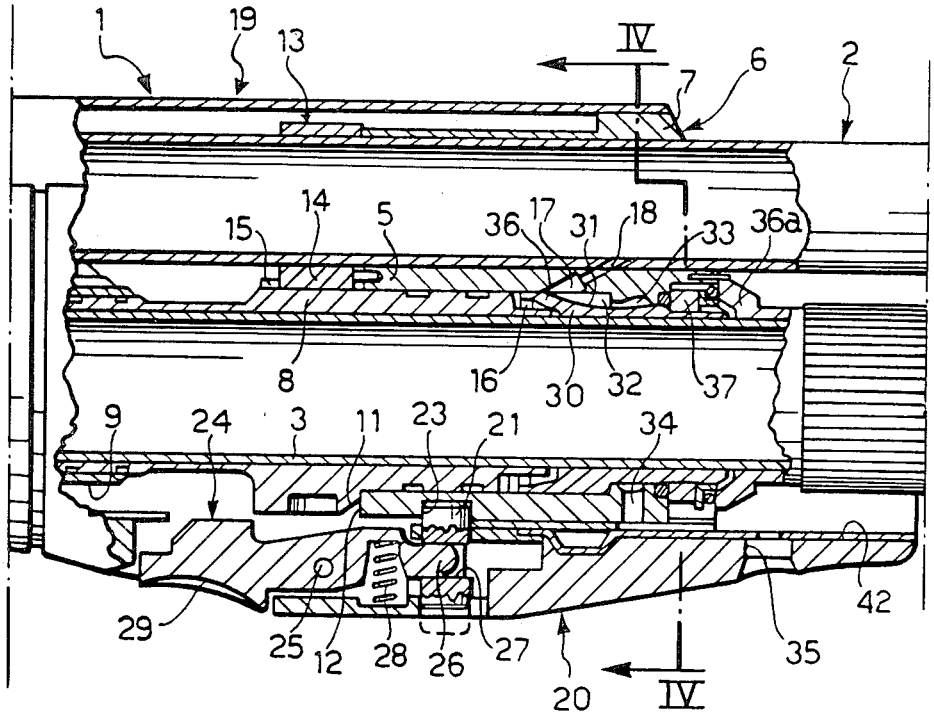
FIG. 2 is a view corresponding to FIG. 1 which illustrates the gun according to the invention in a second operating condition.

FIG. 2 illustrates the movable fore end stock 20 in a second position axially of the gun, corresponding to automatic re-arming thereof: in this position, the bolt member 21 engages in the seat 23 in the cylinder 5, so that the movable fore end stock 20 is rigidly connected to the cylinder 5, and consequently to the barrel 2, of the gun.

A shutter in the form of a tubular body, indicated by the reference numeral 30, is mounted rotatably within the cylinder 5, around the cartridge magazine 3. The rotatable shutter 30 is fixed axially with respect to the cartridge magazine 3 by means of an internally threaded ring nut 36*a* which is screwed on to a front end portion of the cartridge magazine 3 and which prevents the shutter 30 from slipping off the latter.

Figure 5:
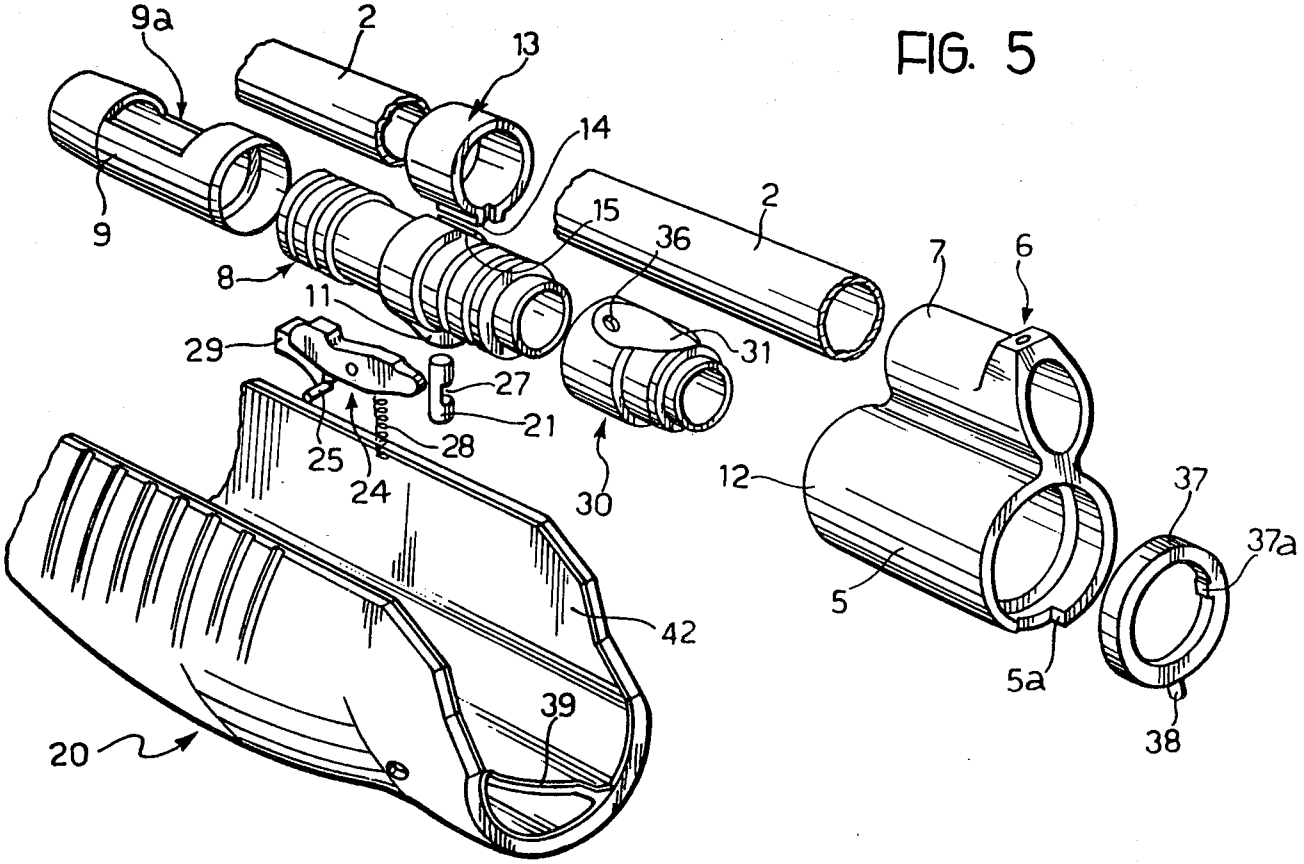
FIG. 5 is an exploded perspective view of parts of the gun illustrated in FIG. 1.

The shutter 30 has a wall portion 31 (see also FIG. 5) spaced from the upper, inner wall of the cylinder 5, adjacent the barrel 2, so as to define a non-annular chamber 32 which communicates permanently with the passages 17, 18 and which also communicates with an annular chamber 33 formed between the inner surface of the cylinder 5 and the outer surface of the shutter 30.

The annular chamber 33 communicates with a radial hole 34 formed in the lower wall of the cylinder 5. When the movable fore end stock 20 is in its first axial position (manual re-arming condition of the gun) illustrated in FIG. 1, the hole 34 communicates with an aperture 35 formed in the wall of the movable fore end stock 20, so that the interior of the gun barrel 2 communicates, through the passages 17, 18, the chamber 32, the annular chamber 33, the hole 34 and the aperture 35, with the external environment, outside of the fore end stock. When the movable fore end stock 20 is in its second axial position, illustrated in FIG. 2 (automatic re-arming condition of the gun), the outlet from the radial hole 34 is closed by the wall 42 of the stock so that communication between the barrel and the external environment is prevented.

The wall portion 31 of the shutter 30 also separates the annular chamber 16, between the piston 8 and the cylinder 5, from the chamber 32 but has an aperture 36 arranged to put these chambers 16, 32 into communication with one another.

The shutter 30 is angularly displaceable about its axis, between two extreme positions: in a first position, illustrated in FIG. 1, the shutter is rotated so as to prevent communication between the aperture 36 and the passage 17; in a second position, illustrated in FIG. 2, the aperture 36 is located in correspondence with the passage 17 so that the annular chamber 16 communicates with the interior of the barrel 2 of the gun via the aperture 36, the chamber 32 and the passages 17, 18.

On a front portion of the tubular shutter 30 is mounted a ring 37 which has a radially-inwardly projecting tooth 37*a* (see FIGS. 3, 4) engaged in a groove 30*a* formed in the outer surface of the shutter 30. The ring 37 is thus fixed for rotation with the shutter 30. In addition, the ring 37, is fixed axially with respect to the shutter 30 by means of the ring nut 36.

The ring 37 has a radially-outwardly projecting pin 38 (see FIGS. 3, 4) which is slidably engaged in a cam slot 39 formed in the metal wall 42 fixed to the interior of the movable fore end stock 20. The slot 39 is essentially helically shaped such that an axial displacement of the movable fore end stock 20 between its first position, illustrated in FIG. 1, and its second position, illustrated in FIG. 2, causes a corresponding rotation of the pin 38, and hence of the ring 37, between a first position (illustrated in FIG. 3) and a second position (illustrated in FIG. 4): when the pin 38 is in the position illustrated in FIG. 3, the shutter 30 is located in the position illustrated in FIG. 1, whilst when the pin 38 is in the position illustrated in FIG. 4, the shutter 30 is located in the position illustrated in FIG. 2.

Thus, displacement of the movable fore end stock 20 from its first position, illustrated in FIG. 1, corresponding to the gun being in its manual re-arming condition, to its second position, illustrated in FIG. 2, corresponding to the gun being in its automatic re-arming condition, causes the shutter 30 to rotate from its first extreme position in which communication between the chamber 16 and the interior of the gun barrel 2 is prevented, to its second extreme position in which this communication is renewed.

The operation of the shot gun described above is as follows:

when it is desired to use the gun in its automatic mode, the movable fore end stock 20 must be located in the position illustrated in FIG. 2. Should the fore end stock 20 previously be in its position illustrated in FIG.

1, corresponding to manual re-arming of the gun, in order to bring it to its automatic re-arming condition, it suffices to operate the key 29 so as to disengage the pin 21 from the seat 22 in the piston 8 and to move the fore end stock 20 forward until the pin 21 engages in the seat 23 formed in the cylinder 5. Once the pin 21 has engaged the seat 23, the movable fore end stock 20 is rigidly connected to the cylinder 5 and, consequently, to the gun barrel 2.

In this condition, as illustrated in FIG. 2, communication between the aperture 35 in the movable fore end stock 20 and the interior of the gun barrel 2 is prevented while the aperture 36 in the rotatable shutter 30 allows communication between the annular chamber 16 and the interior of the barrel 2. During operation of the gun, discharge gases from the barrel 2 must, therefore, flow through the passages 17, 18 and the aperture 36 into the annular chamber 16 and push the piston 8 towards the left (with reference to FIG. 2), with the result that the arming rod 4 is retracted against the action of the helical spring 10. When it is desired to change to manual re-arming of the gun (by pump action), for example, should the weapon jam due to retention of a cartridge case in the chamber, the user must move the fore end stock 20 back into the position illustrated in FIG. 1 after first operating the key 29 to disengage the pin 21 from the seat 23 in the cylinder 5.

Once the pin 21 has engaged the seat 22 in the piston 8 the fore end stock 20 is rigidly connected to the piston 8. Moreover, the aperture 35 is now located in correspondence with the hole 34 in the cylinder 5, allowing communication between the interior of the barrel 2 and the external environment through the passages 17, 18, the chamber 32, the annular chamber 33 and the hole 34. During movement of the movable fore end stock 20 between the position illustrated in FIG. 2 and the position illustrated in FIG. 1, the engagement of the pin 38 in the slot 39 formed in the metal wall 42 fixed to the movable fore end stock, induces rotation of the ring 37 and hence of the shutter 30. The aperture 36 formed in the wall portion 31 of the shutter becomes spaced from the passage 17, preventing communication between the latter and the annular chamber 16. Thus, during operation of the gun, the discharge gases from the barrel 2 are discharged directly to the exterior through the passages 17, 18, the chamber 32, the chamber 33, the hole 34 and the aperture 35.

In this condition, in order to re-arm the gun, it is necessary to retract the movable fore end stock 20 manually to displace the piston 8 and the arming rod 4 against the action of the helical spring 10.

What is claimed is:

1. A shot gun with gas take-off, including: a barrel; an arming rod; a piston-cylinder unit comprising a cylinder fixed with its axis parallel to the barrel and a piston housed in and slidable longitudinally of the cylinder, the piston being operatively connected to the arming rod and the cylinder defining within it a a variable-volume chamber closed by the piston; gas bleed means for putting the interior of the barrel in gas-communication with said chamber; and a fore end stock connected to the barrel, wherein:

said fore end stock is displaceable longitudinally of said barrel between a first position in which said shot gun is manually re-armable and a second position in which said shot gun is automatically re-armable; and wherein, said shot gun further includes:

locking means for locking said fore end stock selectively to said piston in said first position of the stock and to said cylinder in said second position of said stock;

resilient biasing means acting on said locking means to bias the latter to lock the stock in each of said first and second positions;

means for releasing said locking means against the action of the biasing means; and valve means in said gas bleed means operatively connected to said fore end stock to prevent gas bleeding from said barrel into said chamber when the fore end stock is in said first position and to allow said bleeding when the fore end stock is in said second position.

2. A shot gun as claimed in claim 1, wherein said fore end stock defines an aperture open at one end to the external environment, the other end being arranged in said first position of said stock, to communicate with said gas bleed means to allow gas to bleed from said barrel to the external environment.

3. A shot gun as claimed in claim 1 or claim 2, wherein said gas bleed means include intercommunicating passages in said barrel and said cylinder and wherein said valve means comprise:

a tubular shutter mounted coaxially within said cylinder and providing a wall of said variable-volume chamber, said wall defining a through-hole; and means operatively connected to the fore end stock for rotating said shutter about its axis between a first annular position, corresponding to said first position of said stock, in which said shutter cuts off communication between said passage in said cylinder and said variable-volume chamber, and a second angular position, corresponding to said second position of said stock, in which said passage in said cylinder communicates with said variable-volume chamber through said through hole in said shutter.

4. A shot gun as claimed in claim 3, wherein said means for rotating said shutter about its axis comprise:

a helical cam slot formed in the inner wall of said fore end stock and a pin projecting radially outwardly from said shutter and engaged in said slot for sliding and rotational movement relative to said stock.

5. A shot gun as claimed in claim 1, wherein said locking means comprise a bolt slidably mounted in said stock and engageable selectively with said piston and with said cylinder.

* * * * *